United States Patent [19]

Stucky

[11] Patent Number: 4,723,476

[45] Date of Patent: Feb. 9, 1988

[54] REGENERATIVE VALVE

[75] Inventor: Dennis J. Stucky, Hutchinson, Kans.

[73] Assignee: The Cessna Aircraft Company, Wichita, Kans.

[21] Appl. No.: 350,679

[22] Filed: Feb. 22, 1982

[51] Int. Cl.[4] ..... F15B 13/042

[52] U.S. Cl. ..... 91/436; 91/446; 251/63.4

[58] Field of Search ..... 91/436, 446; 251/63.4

[56] References Cited

U.S. PATENT DOCUMENTS

| | | | |
|---|---|---|---|
| 3,071,926 | 1/1963 | Olson et al. | 91/436 |
| 3,438,307 | 4/1969 | Ahlenius | 91/436 |
| 3,474,708 | 10/1969 | Schmiel | 91/436 |
| 3,568,707 | 3/1971 | Shore | 91/436 X |
| 3,737,602 | 6/1973 | Bueler | 251/63.4 |
| 4,349,041 | 9/1982 | Bates | 91/436 X |
| 4,397,221 | 8/1983 | Friesen et al. | 91/420 |

*Primary Examiner*—Edward K. Look

*Attorney, Agent, or Firm*—Edward L. Brown, Jr.

[57] ABSTRACT

A regenerative valve which includes a valve body having a bore therein intersected by first and second control passages connected respectively to a four-way directional control valve; the bore is also intersected by first and second cylinder control cavities connecting with the head end and rod end respectively of a double-acting cylinder; a check valve poppet is seated in said bore blocking flow to the head chamber of the cylinder. A shuttle spool is also positioned in said bore and is movable between a first working position allowing the cylinder to retract its piston and a regeneration position opening flow across the first and second cylinder control cavities while blocking flow to the second control passage. The shuttle spool engages the poppet member in its regeneration position causing the poppet to open a flow path from the first control passage to the first cylinder control cavity and thereby allow regeneration flow.

4 Claims, 3 Drawing Figures

REGENERATIVE VALVE

BACKGROUND OF THE INVENTION

The present invention is a regenerative type valve, also referred to as a speed-up valve, which increases the speed of extension of a double-acting hydraulic cylinder by directing the discharge flow from the rod end of the cylinder into the opposite head end of the cylinder along with pressurized pump flow.

This speed-up movement is normally desired in a light load or low load condition, as for example, dumping a bucket. Functions of this nature are normally the return stroke after a working condition and any time interval which can be saved has a direct effect upon the working capacity of the machine.

Many valve arrangements and circuits for regeneration in double-acting cylinders are known in the prior art. One type of such a valve which includes a single shuttle spool is illustrated in U.S. Pat. Nos. 2,890,683 and 2,590,454. One problem with the last-mentioned single spool type valve is that under a heavy load condition the valve will not function in shifting to its regenerative position. In order to solve this problem, more complex valves have been designed which utilize a combination of separate check valves and shuttle spools, the type of which is illustrated in U.S. Pat. Nos. 4,194,436 and 3,568,707.

The next stage of development for regeneration valves from the compound type valve last mentioned, is the valve design which combines the shuttle spool and check valve into a single bore with the movement of the shuttle spool also functioning to open the check valve for reverse flow.

SUMMARY OF THE INVENTION

The advantage of the present invention over the prior art valve is that the full system pressure is available through the valve for high breakout force since very little pressure is required to open the check valve. In the prior art valve there must be substantial pressure to open its poppet valve since the breakout pressure is exposed to the end area of the poppet, holding it closed. This increased back pressure to open the poppet causes a net decrease in working force output of the cylinder. Another advantage of the present invention is that the valve design has substantially fewer leakage paths than the prior art valves, thereby providing less leakage in the system. A further advantage of the present invention is that the valve design is much simpler to build with fewer design tolerances and therefore less cost.

DESCRIPTION OF THE PREFERRED EMBODIMENT

Figure 1:
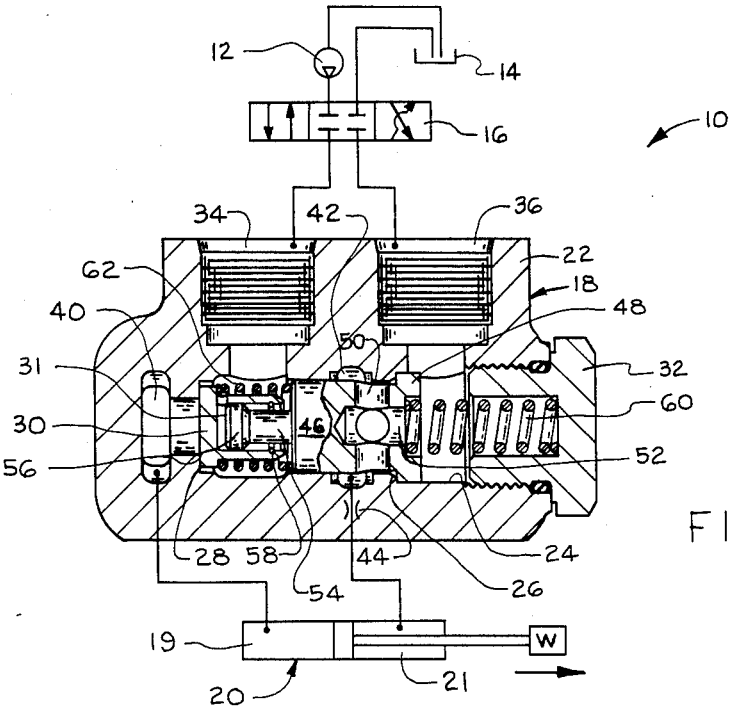
FIG. 1 is a longitudinal sectional view of the speed-up valve in the neutral position with the remaining elements of the hydraulic circuit shown symbolically.

FIG. 1 illustrates a hydraulic system 10 which includes a pump 12, reservoir 14, and a conventional four-way three-position directional control valve 16. Positioned between the control valve 16 and double-acting cylinder 20 is a regeneration valve 18. Regeneration valve 18 includes a valve body 22 having a stepped bore 24 therein for receipt of a shuttle spool 46. Spool 46 is spring-biased in a leftwardly direction, as seen in the drawing, by compression spring 60 to its most leftwardly position against shoulder 26 in bore 24. The spring force on spool 46 is varied by the adjustment of end cap 32. Intersecting valve bore 24 are first and second control passages 34 and 36, respectively, which are in turn connected to directional control valve 16. Also intersecting valve bore 24 are first and second cylinder control passages 40 and 42 which are in turn connected to the head chamber 19 and rod chamber 21 of cylinder 20. Positioned in the hydraulic line between rod chamber 21 and second cylinder control passage 42 is an orifice 44 for controlling the flow rate therethrough.

Shuttle spool 46 includes a flange 48 on the right end thereof which engages shoulder 26 in the valve bore to limit its leftwardly movement in the valve body. Shuttle spool 46 includes a cross bore 50 intersecting an axial bore 52 which allows flow between the rod chamber 21 of the cylinder and the second control passage 36 of valve 18. Extending from the left end of shuttle spool 46 is a stem 54 with an enlarged chamfered end 56 for opening one-way poppet valve 30.

Poppet valve 30 is spring-biased towards a closed position against valve seat 28 by compression spring 62. The force load on spring 60 is much greater than the force from check spring 62, and the spool 46 is basically unaffected by spring 62. With poppet 30 closed, flow is prevented from first control passage 34 into first cylinder control passage 40. Poppet 30 has a cavity 31 at its opposite end for receipt of the chamfered end 56. A snap ring 58 positioned in the outer portions of cavity 31 provides a stop and engagement means for chamfered end 56. As shuttle spool 46 moves to the right, the chamfered end of stem 54 engages snap ring 58 and lifts poppet valve 30 off its seat thereby allowing pump pressure from passage 34 to flow into the head chamber 19 of the cylinder 20.

OPERATION

Figure 3:
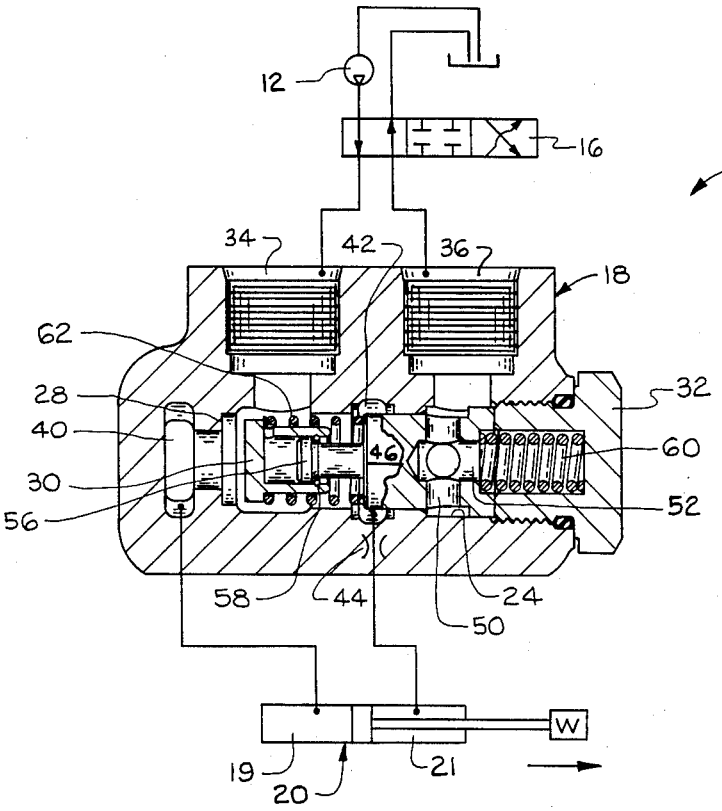
FIG. 3 is a similar view to FIG. 2 with the regeneration valve in the regeneration position.

The regeneration or speed-up valve 18 has a regeneration position, as illustrated in FIG. 3, and a normal working position. The normal working position is retracting the cylinder 20 by pressurizing the rod chamber 21 with the directional control valve 16 shifted to the left to its criss-cross position. In the criss-cross position, pump pressure from pump 12 is directed to control passage 36, while control passage 34 is connected to drain. Since shuttle spool 46 is spring-biased against shoulder 26, pump pressure in passage 36 is open to the rod chamber 21 of cylinder 20 via bores 52 and 50 in the spool. Spool 46, during the retraction of cylinder 20, remains in this position with the pump pressure to move cylinder 20 combining with the force of spring 60 acting on the right end of spool 46, while there is no pressure acting on the opposite end in chamber 34. As the cylinder piston begins to move, flow in the head chamber 19 opens poppet 30 against the force of spring 62 and allows the fluid from the head chamber to return to reservoir with a very low pressure being required to open poppet 30. The cylinder will continue to retract until it reaches the end of its stroke, or the control valve 16 is shifted back to its neutral position of FIG. 1.

Figure 2:
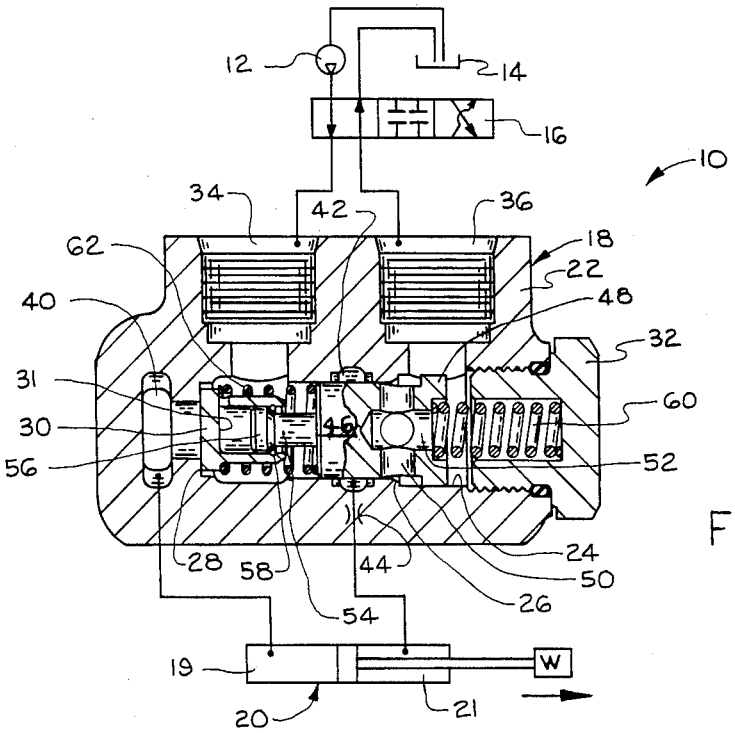
FIG. 2 is a similar view to FIG. 1 with the directional control valve in a regeneration cylinder extension position.

In the regeneration position of the valve 18, which is the extension stroke of cylinder 20, the fluid discharge from the rod chamber 21 of the cylinder is not returned to reservoir, as in a conventional valve, but rather is diverted across to the expanding head chamber 19 of the cylinder in combination with the discharge flow from pump 12. To perform the regenerative function, directional control valve 16 is shifted to the right to its straight-through position, as seen in FIG. 2, whereby first control passage 34 is pressurized by the pump while second control passage 36 is open to drain. The pump pressure directed to control passage 34 has nowhere to go since poppet 30 is resting on its seat 28. When the pump pressure in passage 34, acting against the left end of spool 46, exceeds the force of spring 60, shuttle spool 46 begins moving to the right. Before spool 46 begins to move, rod chamber 21 of the cylinder 20 is open to reservoir through bores 50 and 52. As the spool 46 begins to move to the right, the cross bore 50 on the spool will be valved-off, blocking any oil from the rod end of the cylinder to reservoir, and stopping the cylinder from extending (as illustrated in the FIG. 2 position). As the pressure continues to build in passage 34, the shuttle spool 46 continues to move to the right, compressing spring 60 until the small chamfered end 56 on the end of the spool comes in contact with the retaining ring 58 on poppet 30. At this point, the force required to shift the spool must increase to overcome the force holding the poppet 30 against its seat. This will occur because the end area of the spool is greater than the end area of the poppet, as can be seen in the drawing. When this pressure is exceeded, poppet 30 is pulled off its seat 28, allowing oil to flow from pump 12 into the head chamber 19 of the cylinder. Since flow from the rod chamber 21 of the cylinder is blocked, pressure continues to build in passage 34. This head end pressure creates additional force, causing the spool 46 to further shift until the land of spool 46 opens flow between cylinder control passage 42 and first control passage 34, as illustrated in FIG. 3. Pump pressure in passage 34 is now exerted on both the head chamber 19 in the cylinder, as well as the rod chamber 21. However, due to the area differential in the two chambers caused by the area of the cylinder rod, a greater force is exerted from the head chamber 19 of the cylinder, thereby causing the cylinder 20 to extend its piston and function as a cylinder with an effective piston area equal to that of the rod area. In this position, the discharge flow from the rod chamber 21 flows across poppet 30 and combines with the pump discharge flow from pump 12 into the head chamber 19 of the cylinder. The presence of orifice 44 creates a pressure drop between rod chamber 21 and control passage 34, such that the pressure acting on the left end of spool 46 is controlled by the flow from the pump and not the flow from the cylinder. If the latter was the case, a situation could arise where the pump flow was cut-off by shifting control valve 16 to neutral and the flow from the rod chamber 21 would maintain the spool 46 shifted in its regeneration position. The size of orifice 44 would depend on the rate of pump flow and cylinder size. The orifice 44 is only needed in the regeneration function, therefore a one-way orifice could be used with free flow in the opposite direction, in place of orifice 44.

In the regeneration position, the cylinder extension speed is substantially increased, depending upon the piston and rod diameters. The regeneration function typically moves at a speed four times that of the normal working speed and is used, as for example, to quickly lower the bucket before the beginning of another digging stroke.

Regeneration valve 18 will allow external loads to be applied on either end of the cylinder without allowing the cylinder rod to extend or retract. If this external load causes pressure to build in the head end, the oil cannot leak through the valve to the rod end because it has a smaller volume. If the external load causes pressure to build in the rod chamber 21, the poppet valve 30 will seat allowing only a very small leakage into the head chamber 19.

The regeneration valve 18 of the present invention allows full system pressure to be utilized in the rod chamber 21 for a high breakout force since the pressure in head chamber 19 is substantially zero.

Having described the invention with sufficient clarity to enable those familiar with the art to construct and use it,

I claim:

1. In a hydraulic circuit having a pump and reservoir a four-way directional control valve connected to the pump, a double acting cylinder supplied by the control valve and a regenerative valve positioned between the control valve and said cylinder, the improved regeneration valve comprising:

a valve body;

a spool bore in the body;

a first control passage in the body intersecting the bore and communicating with the directional control valve;

a second control passage in the body intersecting the bore and communicating with the control valve;

first and second cylinder control cavities in the body intersecting the bore and communicating with the head end and rod end of said double-acting cylinder respectively;

a valve seat between the first cylinder control cavity and the first control passage;

a biased check valve poppet positioned on said seat blocking flow from the first control passage to the first cylinder control cavity while allowing flow in the opposite direction, the poppet includes an extended opening therein co-axial with the spool bore with a retaining means in the opening;

a valve spool means positioned in the bore having a working position blocking flow between the second cylinder cavity and the first control passage while allowing flow between the second control passage and the second cylinder cavity whereby the pump flow is directed to the rod end of the cylinder, and a regeneration position blocking flow between the second cylinder cavity and the second control passage while opening a flow path between the second cylinder cavity and the first cylinder cavity;

the valve spool means includes an integral stem coaxial with the spool bore and said extended opening which in the regeneration position engages the retaining means in the extended opening and holds the check valve poppet open for regeneration flow, and biasing means engaging the valve spool means towards its working position;

servo means acting on the valve spool in opposition to the biasing means urging the valve spool means towards its regeneration position.

2. A regenerative valve as set forth in claim 1, wherein the timing of the valve spool is such that in the regeneration position, the flow to the second control passage is blocked before the valve spool stem opens the check valve.

3. A regenerative valve as set forth in claim 1, wherein the timing of the valve spool is such that in the regeneration position the valve spool stem opens the check valve before flow from the second cylinder cavity opens to the first control passage.

4. A regenerative valve as set forth in claim 1, including orifice means between the second cylinder control cavity and the rod chamber of the cylinder.

* * * * *